United States Patent [19]

Regan et al.

[11] 4,083,162

[45] Apr. 11, 1978

[54] CONNECTOR ASSEMBLY

[76] Inventors: Joseph F. Regan, 102 Meadowbrook Rd., Spring Lake Heights, N.J. 07762; Robert R. Regan, 12 Prospect Ave., North Arlington, N.J. 07032

[21] Appl. No.: 785,818

[22] Filed: Apr. 8, 1977

[51] Int. Cl.[2] ..... E04B 1/41

[52] U.S. Cl. ..... 52/699; 85/3 S; 249/94

[58] Field of Search ..... 249/94, 177; 52/699, 52/204; 85/80, 3 S; 151/37; 403/118, 361

[56] References Cited

U.S. PATENT DOCUMENTS

| | | | |
|---|---|---|---|
| 1,145,385 | 7/1915 | Marble | 52/701 |
| 2,059,153 | 10/1926 | Snyder | 85/3.5 |
| 3,148,433 | 9/1964 | Carriker | 249/177 |
| 3,982,363 | 9/1976 | Dorris | 52/699 |

*Primary Examiner*—James L. Ridgill, Jr.
*Attorney, Agent, or Firm*—Sughrue, Rothwell, Mion, Zinn and Macpeak

[57] ABSTRACT

A connector assembly for use in aggregate structures cast over a form has a connector socket body embedded in the structure, the body having a threaded bore therein. An elongated locking member extends through a hole in the form and is threadedly engaged in the bore and has a lower section with a sleeve thereon. Projecting from the sleeve are a plurality of resilient splines which extend angularly outward from the sleeve in the direction of the socket body for engagement against the form to lock the socket body in place during solidification of the aggregate thereabout.

2 Claims, 7 Drawing Figures

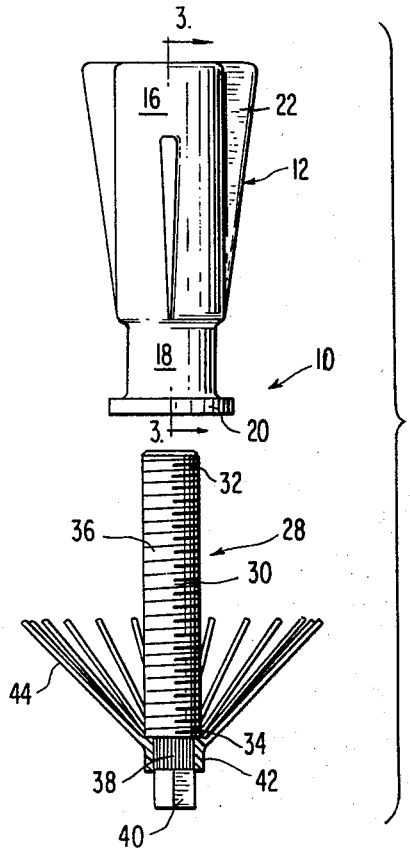
FIG.1
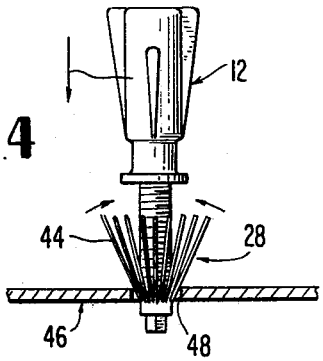
FIG.4
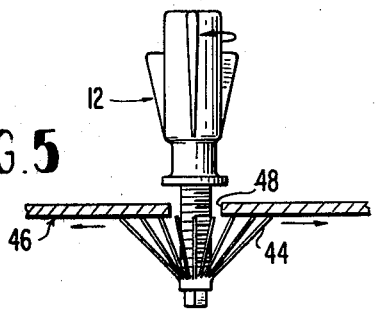
FIG.5
FIG.6
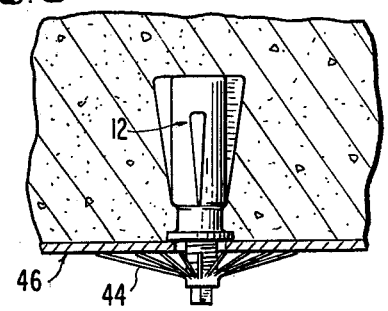
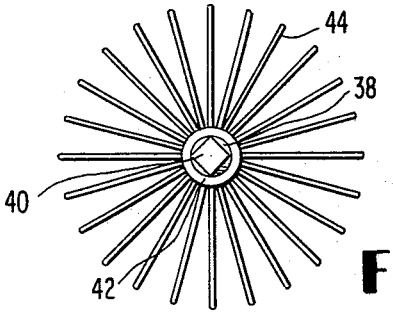
FIG.2
FIG.7
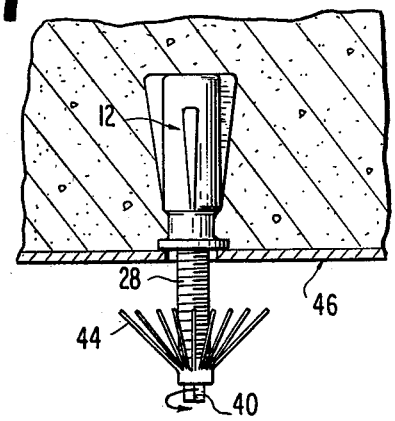
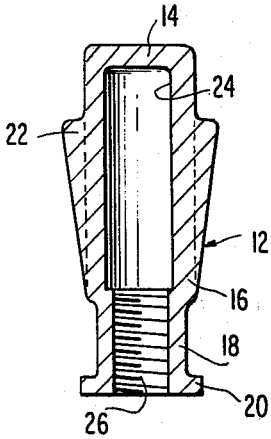
FIG.3

CONNECTOR ASSEMBLY

BACKGROUND OF THE INVENTION

1. Field of the Invention

This invention relates to a connector body for incorporation in an aggregate structure such as a concrete floor, ceiling, deck or the like.

2. Statement of the Prior Art

The installation of metallic connectors in monolith aggregate structures has long been practiced. Representative prior patents in the field are as follows:

| Pat. No. | Patentee | Date Issued |
|---|---|---|
| 1,323,067 | Keith | Nov. 25, 1919 |
| 1,416,433 | Ackerman | May 16, 1922 |
| 3,290,851 | Sherburne | Dec. 13, 1966 |
| 3,333,388 | Sandin | Aug. 1, 1967 |
| 3,405,497 | McNair | Oct. 15, 1968 |

SUMMARY OF THE INVENTION

The present invention relates to a new and novel approach to the installation of connector bodies in aggregate structures, and involves a splined locking member which provides ease of location and maintenance of location of the connector, and is installed from the same side of the form as that on which the connector is to be located. In heretofore known devices, it has been necessary to have access to both sides of the form in order to accomplish this.

The present invention is used in those situation wherein a ceiling or the like is to be cast over a form. In accordance with present construction methods, a series of connector bodies are to be cast into the ceiling for subsequent use in suspending electrical fixtures etc. Utilizing the apparatus here provided, it is possible to simply form a hole in the form at the desired location of the connector body and insert a locking assembly with the connector body engaged therewith through the hole. The locking assembly includes means which then engage the opposite side of the form to permit tightening for positive location of the connector during the pouring and set-up of the aggregate. The locking assembly has tool engagement means thereon to facilitate removal after the aggregate has solidified.

Additional objects and advantages of the invention will become apparent to those skilled in the art from a consideration of the following specification when read in conjunction with the annexed drawing.

BRIEF DESCRIPTION OF THE DRAWING

FIG. 1 is a disassembled side elevational view of a connector body and locking assembly hereof partially in cross section to show details;

FIG. 2 is a bottom plan view of the locking assembly;

FIG. 3 is a vertical cross sectional view on line 3—3 of FIG. 1, looking in the direction of the arrows; and FIGS. 4 through 7 inclusive show sequentially the employment of the units hereof.

DESCRIPTION OF THE PREFERRED EMBODIMENT

Referring to the drawing in more detail, an connector assembly according to this invention is generally identified therein by reference numeral 10. The connector assembly includes a connector socket body 12 having a closed top wall 14 and generally tubular side wall 16.

The side wall is reduced in diameter at its lower portion 18 and terminates at a lower outward flange 20. The side wall also has outward projections 22, configuration being designed to securely anchor the socket body in an aggregate structure. The socket body has an internal bore 24 and is closed at its top by the wall 14. The bore is open at the lower end of the socket, and the lower portion 18 is internally threaded at 26.

The locking assembly 28 for the connector body comprises an elongated, substantially cylindrical locking member 30 having an upper end 32 and a lower end 34. The member 30 is provided with external threads 36 throughout its length for engagement with the threads 26 of the socket bore, as described below.

On the end 34 of the locking member is a reduced diameter lower end portion 38 and extending from the portion 38 is a tool engaging segment 40. Fixedly secured about the portion 38 is a sleeve 42 formed of a resilient but sturdy material such as structural nylon or other plastic. Integrally or otherwise connected to the sleeve are a plurality of splines 44. The splines are circumferentially spaced about the sleeve and project angularly and radially outward toward the upper end 32 of the member 30. The splines are resilient and are compressable inwardly.

Referring to FIGS. 4 through 7, a form base 46 is there shown on which a floor or ceiling is to be cast. In FIG. 4, a hole 48 has been formed in the form base at the desired location of a connector. It will be noted that the hole may be formed from above without the necessity to work below the base. As the body assembly 28 is pushed through the hole, the splines 44 are compressed to pass therethrough. However, in FIG. 5, when the splines are completely through the hole, by virtue of their plastic memory they spring outwardly and grip the lower side of the base. The socket body is then rotated in counter-clockwise direction until the flange 20 rests on the base and is tightly clamped thereto. The aggregate is thereafter poured (FIG. 6) and permitted to harden. Finally, as shown in FIG. 7, it is seen that the body assembly may be readily removed and reused by turning it in a clockwise direction after set-up of the aggregate. A wrench or other tool is engaged with the segment 40 for accomplishing that purpose when required.

We claim:

1. A connector assembly for use in a structure formed of initially fluid condition and subsequently solid aggregate and having an aggregate form base over which the aggregate is placed in said initial condition, comprising the combination of:

- a connector socket body having a closed top wall, a tubular side wall, and having a bore formed therein;
- a lower flange on the side wall defining the opening of the bore, said bore being threaded internally adjacent said opening;
- an elongated, substantially cylindrical locking member having a main body section, said main body section being externally threaded and being threadedly engaged in said bore of said socket body;
- the locking member having a reduced lower end portion and having a lower engagement segment;
- a sleeve fixedly secured on said reduced lower end portion;
- a plurality of resilient splines extending from the sleeve in circumferentially spaced, radially outward, angular relation thereto, and being directed toward the socket body;

the form base having a hole formed therein, and the locking member being inserted through said hole by compression of the splines to extend therethrough, the splines expanding upon passage through the holes to engage against the form base and to clampingly grip the form base as the socket body is tightened on the locking member, the locking member being disengageable when the aggregate is in its solid condition and the socket is embedded therein, said socket body sidewall having a series of projections thereon to prevent rotation of the socket body upon hardening of the aggregate, and the lower engagement segment terminating in a bolt head to effected threaded engagement of the cylindrical locking member to said socket body.

2. The invention of claim 1, wherein:

said sleeve and splines are formed of plastic.

* * * * *